US006367515B1

(12) United States Patent
Roelstraete

(10) Patent No.: US 6,367,515 B1
(45) Date of Patent: Apr. 9, 2002

(54) LOOM WITH BAND-MOUNTED GRIPPERS COMPRISING AT LEAST ONE GRIPPER BAND AS WELL AS A GUIDE

(75) Inventor: Kris Roelstraete, Zwevegem (BE)

(73) Assignee: Picanol N.V. (BE)

( * ) Notice: Subject to any disclaimer, the term of this patent is extended or adjusted under 35 U.S.C. 154(b) by 0 days.

(21) Appl. No.: 09/784,442

(22) PCT Filed: Jul. 19, 1999

(86) PCT No.: PCT/EP99/05141

§ 371 Date: Feb. 26, 2001

§ 102(e) Date: Feb. 26, 2001

(87) PCT Pub. No.: WO00/11251

PCT Pub. Date: Mar. 2, 2000

(30) Foreign Application Priority Data

Aug. 25, 1998 (DE) ..... 198 38 476

(51) Int. Cl.[7] ..... D03D 47/27
(52) U.S. Cl. ..... 139/449
(58) Field of Search ..... 139/449

(56) References Cited

U.S. PATENT DOCUMENTS 4,777,989 A * 10/1988 Pezzoli ..... 139/449
5,806,570 A * 9/1998 Speich ..... 139/449

* cited by examiner

*Primary Examiner*—Andy Falik
(74) *Attorney, Agent, or Firm*—Bacon & Thomas, PLLC

(57) ABSTRACT

A loom fitted with rapiers and including at least one rapier for one gripper, a guiding device (19, 20), guiding surface (31) associated with the top side of a guide element (17) of the gripper (7) and with the top side of a rapier (9) extending over more than one third the width of the guide element (17) and of the rapier (9). A fastener (35) of the gripper (7) is mounted to the side of the reed (6) in eccentrically offset manner to the guide element (17).

11 Claims, 7 Drawing Sheets

LOOM WITH BAND-MOUNTED GRIPPERS COMPRISING AT LEAST ONE GRIPPER BAND AS WELL AS A GUIDE

BACKGROUND OF THE INVENTION

1. Field of the Invention

The invention relates to a rapier loom comprising at least one rapier for driving a gripper which is held by fastening means and of which the center of gravity is situated above the top side of the rapier, further comprising a batten bearing a reed and fitted with guiding means comprising guiding surfaces for the rapier, which are associated with the side of the top side of the rapier away from the reed, with the bottom side of the rapier and with the side surfaces of a downward-pointing rib.

2. Description of the Related Art

A rapier loom of the initially cited kind is used by applicant in the rapier looms it is marketing at the present time. Its design corresponds essentially to that of U.S. Pat. No. 5,413,151. A guide element is mounted in extension of the rapier and a gripper is affixed at the longitudinal center of said element. The width of this guide element corresponds to that of the rapier and on its side away from the reed, the guide element is fitted with a downward pointing rib. The guide element and the rapier are guided by hook-shaped guiding means mounted on the batten and open to the reed. The hook-shaped guiding means are fitted with guiding surfaces associated with the top side of the guide element and of the rapier as well as with the bottom side of the guide element and of the rapier. Another guiding surface is associated with that side surface of the rapier and the guide element which is away from the reed. Further guiding surfaces guide the rib of the guide element in the transverse direction, as a result of which the guide element together with the gripper is guided omni-directionally. This design operates reliably. However a problem arises in that in this design, and in fact in any other design used in practice, strong wear takes place rapidly and entails replacing the guide element.

In another practical design, for instance known from U.S. Pat. No. 4,834,146, hook-shaped guide elements are mounted on the batten and almost wholly enclose the top and bottom sides of the rapier. The bottom side of the rapier is fitted with a longitudinal channel engaged by guidance of the hook-shaped guides as a result of which the rapier shall also be guided transversely. Because the hook-shaped guides almost completely enclose the rapier, the gripper is affixed laterally to the rapier. This lateral gripper affixation to the rapier entails substantial transverse stresses on the rapier, especially during decelerations/accelerations, and as a result relatively heavy wear materializes. Once a given degree of wear has taken place, this design requires exchanging the full rapier.

In order to circumvent the wear and other drawbacks of the design disclosed in U.S. Pat. No. 4, 834,146, the European patent document 0,709,505 A1 discloses replacing the hook-shaped guides with two different kinds of guides, one of said kinds of guides being associated with the top side of the rapier and the guides of the other kind being associated with the bottom side of the rapier. While this design allows grinding the guides of the two guide devices, the drawback remains that the gripper is mounted laterally and accordingly also the entailed transverse stresses.

In order to avert the transverse stresses of the design of U.S. Pat. No. 4,834,146 and of the European patent document 0,709,505 A1, the European patent document 0,715, 009 A1 discloses guiding only the bottom side of the rapier by means of guide elements and to mount the gripper centrally on the top side of the rapier. The gripper elements engage a channel in the bottom side of the rapier. The gripper must be designed so that its center of gravity coincides with that of the rapier or shall remain below it. However this document fails to disclose how to configure a gripper so that its center of gravity shall coincide with, or be below, that of the rapier.

It is known also from U.S. Pat. No. 5,183,084 to allow a partly overlapping motion of a rapier with a gripper affixed centrally to its end with that motion by which the guides are inserted into the shed. This design employs two kinds of guide devices, one of which is fitted with only one guide for the bottom side of the rapier and the other with a guide for an upper side edge, a side surface and a guideway for the edge zone of the bottom side. In this design, the rapier is supported only at its bottom side across a large part of its displacement, and there is danger as a result especially when accelerating/decelerating, that the rapier shall rotate about its longitudinal axis, in particular when high speeds are desired.

SUMMARY OF THE INVENTION

The objective of the invention is to improve a rapier loom of the initially cited kind so that wear shall be reduced.

The invention solves this problem in that the guide surface of the guiding means associated with the top side of the rapier extends over more than one third the width of the rapier and in that the gripper fastening means are mounted offset relative to the longitudinal center plane of the rapier in the direction towards the reed.

The invention is based on the insight that the main cause of wear are forces generated in particular when accelerating/decelerating the gripper head of which the center of gravity is situated above the top side of the rapier, whereby said forces tend to rotate the rapier and if present a guide element extending the rapier and carrying the gripper, about the longitudinal axis. Accordingly the invention calls for guides opposing the rapier rotation which are designed with most advantageous possible leverage to act on the rapier in order to reduce the forces entailing rotation. In particular this shall be the guide acting on the rapiertop side, which shall advantageously act on the rapier if extending over more than a third the width of the guide element and of the rapier, possibly as much as half. In order that nevertheless the gripper position shall remain unchanged, the gripper fastener(s) shall be mounted in such shifted manner that adequate space is available for the guide to act.

In an advantageous embodiment of the invention, the rib is mounted a distance from the rapier's side surface which is away from the reed. Appropriately and furthermore, the guiding means shall be fitted with guiding surfaces on each side of the rib for the bottom side of the rapier. By shifting the rib toward the center of the rapier, a space of the bottom side of the rapier and/or of the guide element is created in particular on rib side away from the reed to which a guiding surface is associated which shall oppose rotation by means of an advantageous leverage and hence by means of comparatively low forces.

Further advantages and features of the invention are elucidated in the following description of illustrative embodiments and sub-claims.

DETAILED DESCRIPTION OF THE INVENTION

Figure 1:
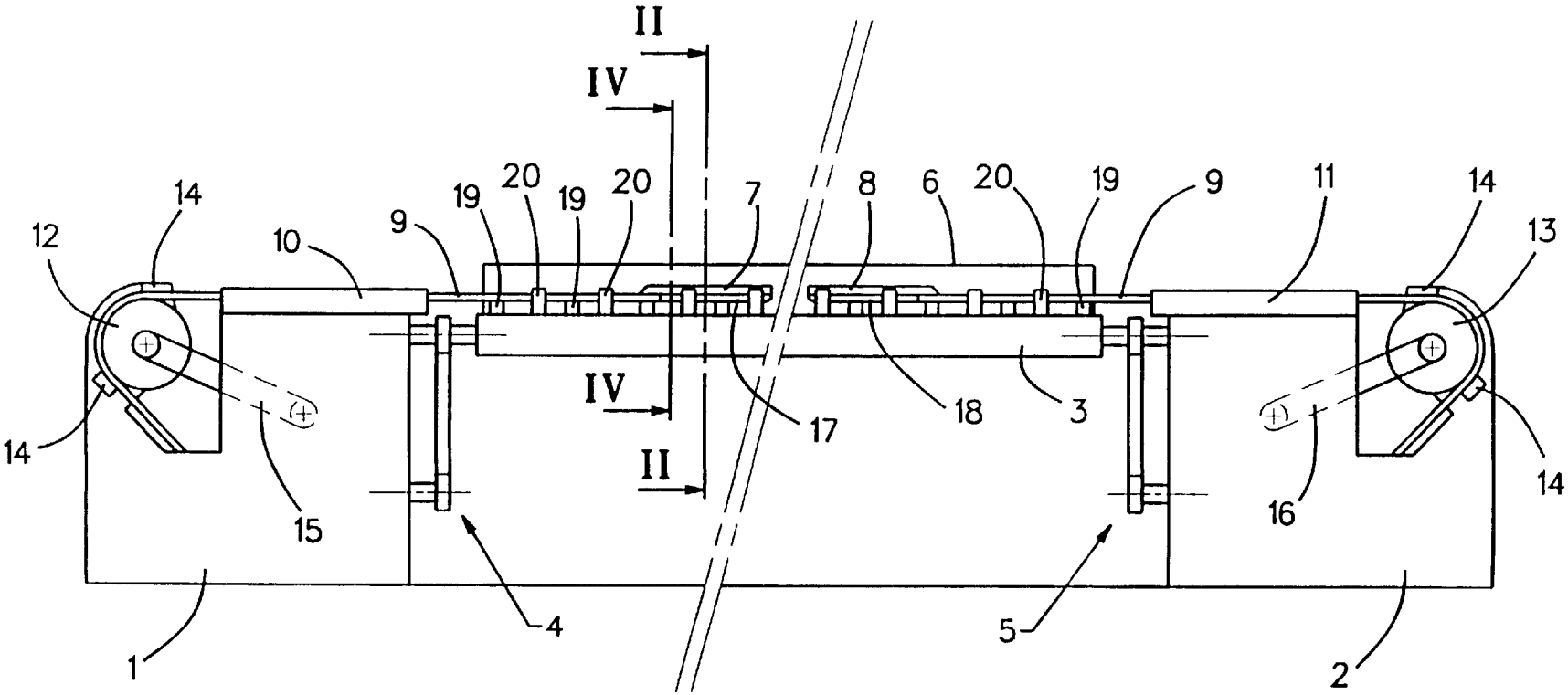
FIG. 1 is a schematic cross-section of a rapier loom of the invention.

The loom shown in FIG. 1 comprises two side segments 1, 2 supporting a batten 3. The batten 3 is fitted on each side with a drive 4, 5 driving it into reciprocation. A reed 6 is mounted on the batten 3 to beat inserted filling yarns against the fell line.

The fillings are inserted in known manner by means of a drawing gripper 7 and a receiving gripper 8 into a shed. On one side of the loom and in manner known per se, the drawing gripper 7 takes charge of a filling and moves it as far as about the loom center, that is into the middle of a shed. Therein said filling is taken over by the receiving gripper 8 which then moves it to the opposite side of the loom.

The drawing gripper 7 and the receiving gripper 8 each are driven by a rapier 9 pushing the receiving gripper 8 and the drawing gripper 7 each into an open shed and then pulling them out again. Preferably the rapiers 9 are made of a fiber-reinforced synthetic material and exhibit a flat, rectangular cross-section, their flat sides each being situated in approximately horizontal planes. The rapiers 9 are guided in the region of their side segments 1, 2 by stationary guiding surfaces 10, 11. The rapiers are fitted with a row of holes in their longitudinal center and are driven by gears 12, 13 on which they run. They are kept at the peripheries of the gears 12, 13 by guide stubs 14.

The gears 12, 13 are driven into a rocking motion by drives 15, 16. The drives 15, 16 are synchronized with the drives 4, 5 of the batten 3.

The drawing gripper 7 and the receiving gripper 8 are mounted on guide elements 17, 18 both configured at the front ends of the rapiers 9. The guide elements 17, 18 are designed to match the cross-section of the rapiers 9 except for a rib which is fully discussed below.

Figure 2:
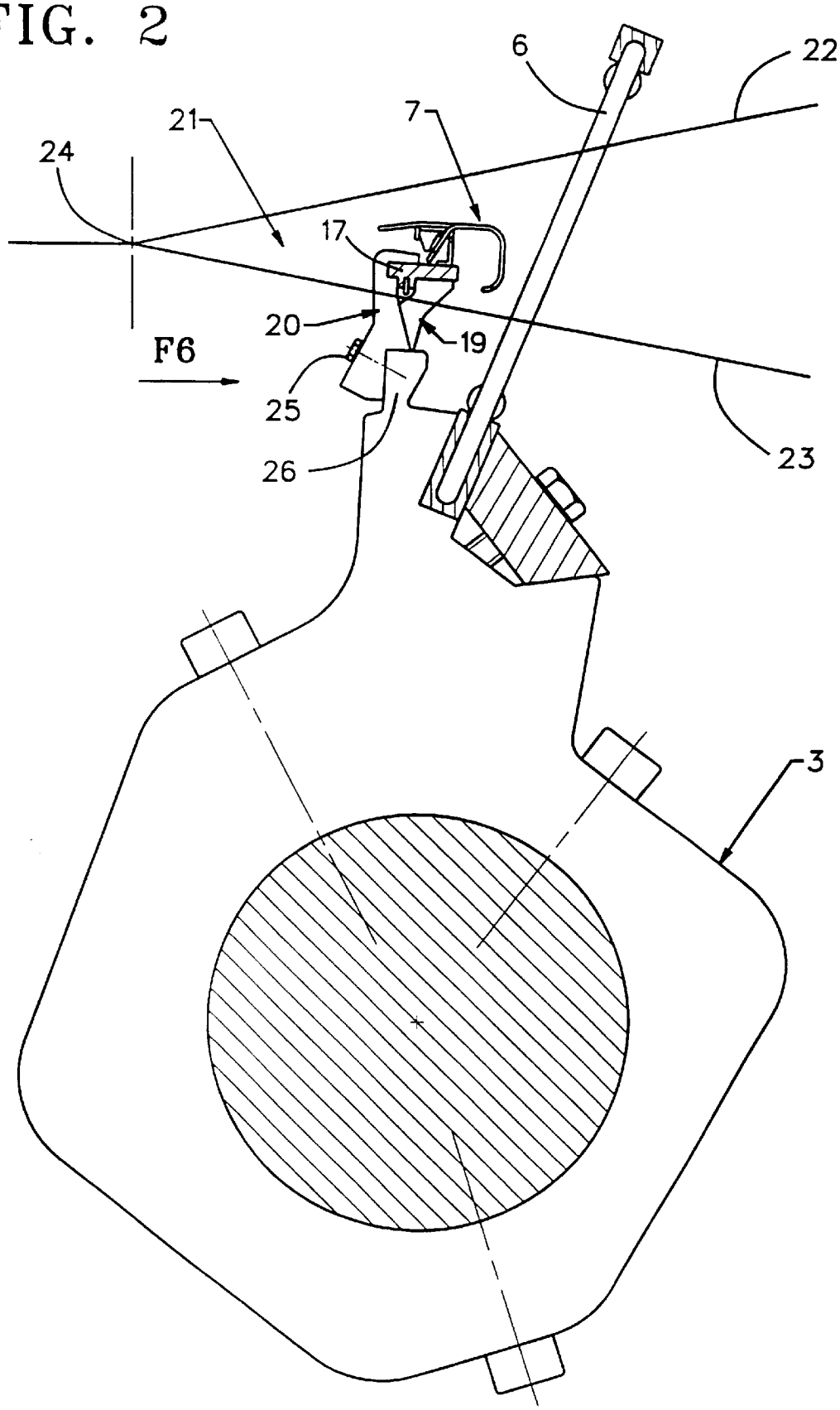
FIG. 2 is a section on an enlarged scale along line II—II of FIG. 1.
Figure 3:
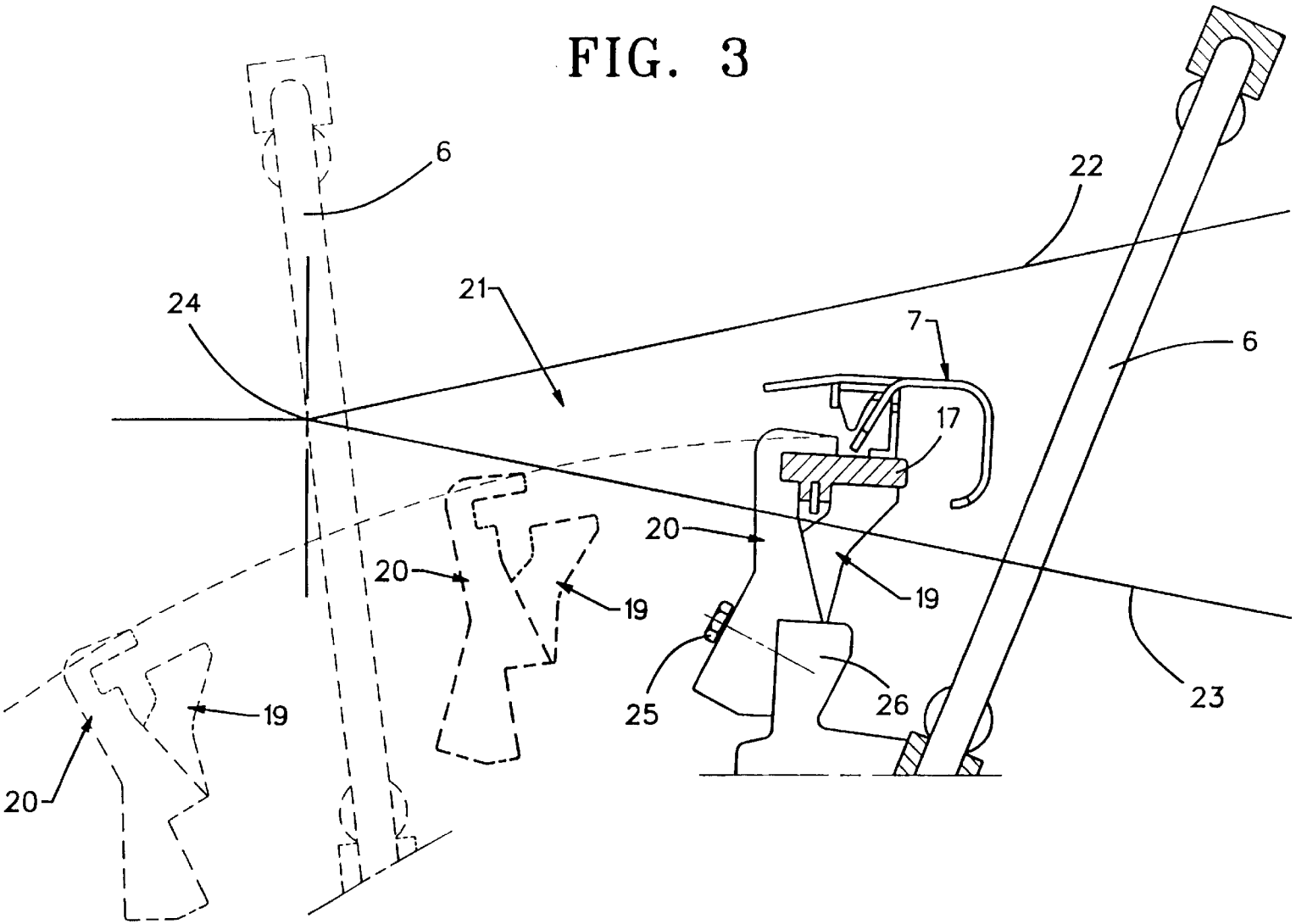
FIG. 3 is a cutaway of FIG. 2 on a still larger scale showing various positions of a reed and guiding means.

Within the region of the shed, the guide elements 17, 18 of the grippers 7, 8 and the rapiers 9 are guided by guiding means 19, 20. These guiding means 19, 20, which are discussed more comprehensively below, are thin in the shed's longitudinal direction and for reasons of clarity are shown much wider than actual in FIG. 1. The guiding means 19, 20 are mounted on the batten 3 and move jointly with this batten 3 and the reed 6. In the process they enter a shed 21 from below as indicated in FIGS. 2 and 3. This shed 21 is constituted by an upper set of warps 22 and a lower set of warps 23 which are raised and lowered by shed-forming means not shown and which converge in the fill line 24. The yarn guiding means 19, 20 are so narrow in the longitudinal direction of the shed 21 that they can pass between the warps of the lower set of warps 23. When the reed 6 is moved toward the fell line 24 to beat up a filling (dashed position in FIG. 3), the guiding means 19, 20 are moved out of the shed 21 through the lower set of warps 23. If the reed 6 is returned into the position shown in solid lines in FIG. 3, then the guiding means 19, 20 again pass through the lower set of warps 23 and enter the shed 21. At beatup of a filling, the shed 21 is changed, at least part of the warps of the upper set of warps 22 is moved down and at least part of the warps of the lower set of warps 23 is moved up. As shown by FIGS. 2 and 3, the guiding means 19, 20 are affixed by screws 25 to a batten structure 26.

As already mentioned above, the drawing gripper 7 and the receiving gripper 8 are mounted on guide elements 17, 18 which are configured to be aligned with and an extension of the rapiers 9. Only a drawing gripper 7 together with its guide element 17 is shown in FIGS. 2 through 5. Because the guide element 18 of the receiving gripper 8 is mirror-symmetrically identical, the description of the guide element 17 also applies to the guide element 18.

The guide element 17 and the guiding means 19,20 are discussed in the following in particular in relation to FIG. 4. The guide element 17 is fitted with a downward-pointing rib 27 comprising sides which run perpendicularly to the bottom side of the guide element 17 and hence also to the bottom side of the rapier 9. The rib 27 is slightly offset to the center relative to the side surface of the guide element 17 away from the reed 6. A metallic deflection rail 28 is inserted into the rib 27 of the synthetic guide element 17. The guiding means 19 are fitted with an essentially horizontal guiding surface 29 associated with the bottom side of the guide element 17 and hence also with the bottom side of the rapier 9 in the zone next to the rib 27 and facing the reed 6. The guiding means 19 are fitted with a further guiding surface 30 running perpendicularly to the guiding surface 29 and associated with the side of the rib 27 facing the reed 6.

The guiding means 20 are hook-shaped. Their open side faces the reed 6. They comprise a substantially horizontal guiding surface 31 associated with zone of the top side of the guide element 17 and of the rapier 9 facing away from the reed 6. This guiding surface 31 runs over more than one third the width of the guide element 17 and preferably as far as about half the guide element 17 and the rapier 9. The guiding means 20 are fitted with a further and substantially horizontal guiding surface 32 associated with the bottom side of the guide element 17 and the rapier 9 in that zone near the rib 27 which is away from the reed 6. The guiding surface 32 is adjoined by a guiding surface 33 perpendicular to it associated with the side of the rib 27 which is away from the reed 6. Lastly the guiding means 20 also comprise a guiding surface 34 between the guiding surface 31 and the guiding surface 32 which is associated with the side surface of the guide element 17 and the rapier 9 away from the reed 6.

Fasteners 35 for the gripper 7 which are eccentrically offset toward the reed 6 are mounted on the guide element 17 to allow an adequately long guiding surface 31 of the guiding means 20. The guiding surfaces 29, 32 and 31 vertically guide the guide element 17 and the rapier 9. The guiding surfaces 30, 32 and 34 horizontally guide the guide element 17, and as a result the guide element 17 together with the gripper 7 is guided omni-directionally. In the zone outside the guide element 17, the rapier 9 is guided only unilaterally by means of the guiding surface 34.

For practical reasons tolerances of the order of magnitude of 0.3 mm must be allowed between the guiding surfaces 29, 30, 31, 32, 33 and the guide element 17. Especially in the presence of accelerating/decelerating forces and on account of the eccentric center of mass of the gripper 7 relative to the guide element 17 and the rapier 9, such forces tend to rotate the guide element 17 and the rapier 9. On account of said forces, the guide element in fact does rotate within the range of said tolerances, and consequently and in particular when rotating (counter-clockwise) away from the reed 6, quasi point-loads are applied in the zone of the guiding surfaces 30, 31 and 32. In order to minimize wear in spite of said near point-loads, the guiding surfaces 30, 31 and 32 are so configured and designed that said load points act with maximal leverage against the said rotation and that thereby the forces of the quasi point loads can be kept relatively weak.

The guiding means 19, 20 typically are configured equidistantly in the longitudinal direction of the shed 21. To reduce strong loads on the rapier 9 and/or the guide element 17 in those zones where accelerations and decelerations occur tending to rotate the guide element 17 together with the gripper 7 away from the reed 6, the guiding means 20 and as called for also the guiding means 19 may be mounted in closer sequence in said zones.

Using two different kinds of guiding means 19,20 each constituting mutually opposite guiding surfaces 29, 30 and 31, 32, 33, 34 offers the advantage that all guiding surfaces are accessible to a grinding tool and therefore can be processed by grinding. The guiding surfaces 29, 30 of the guiding means 19 can be processed using separate grinding procedures or a profile grinder disk. The guiding surfaces 31, 32, 33, 34 of the guiding means 20 allow very accurate processing using a profile grinder disk. Such grinding of the guiding surfaces 29 through 34 offers the advantage of attaining very smooth guiding surfaces and observing very tight tolerances between these guiding surfaces.

Figure 5:
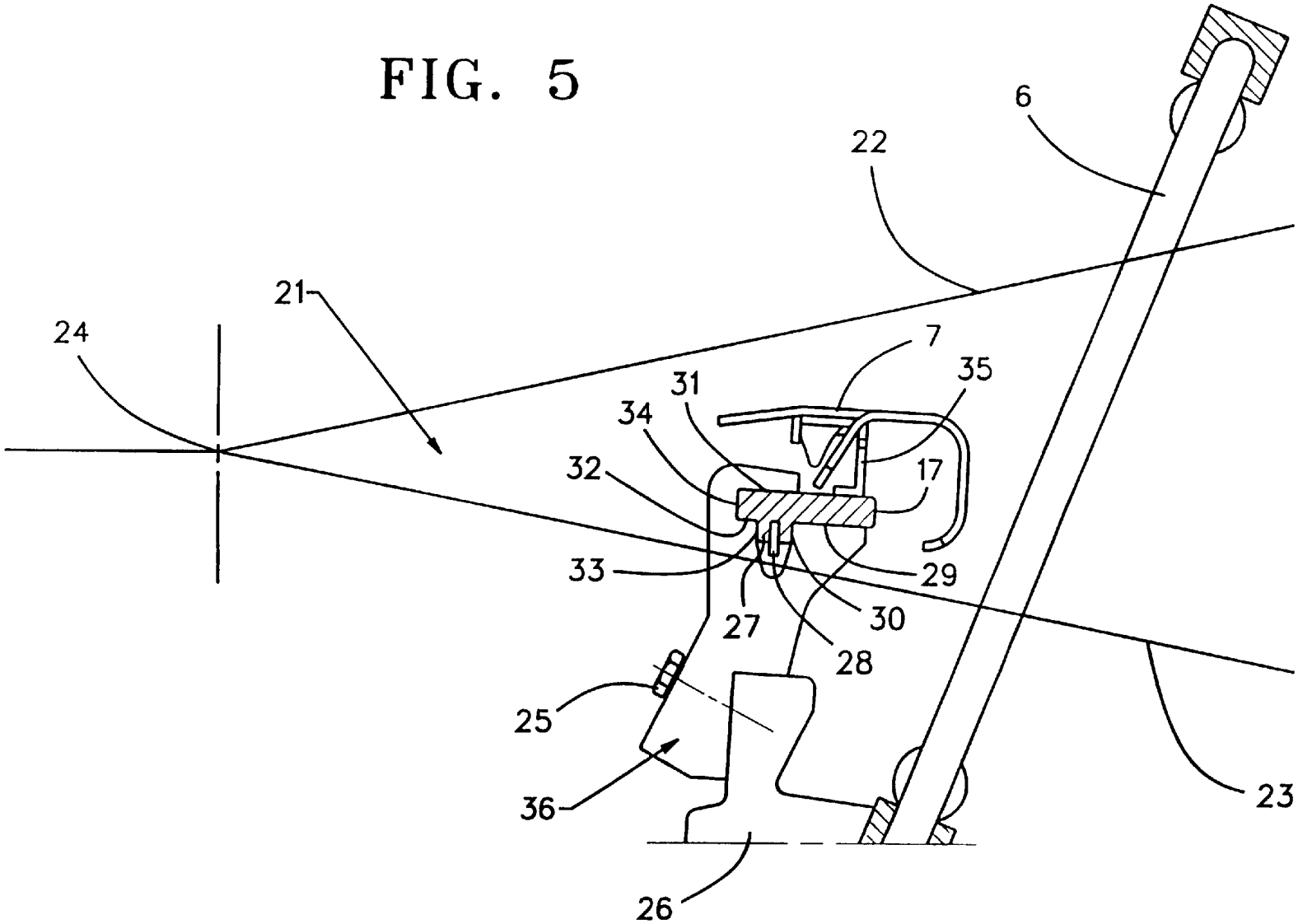
FIG. 5 is a section similar to that of FIG. 4 of an embodiment variation of guiding means.

As shown in FIG. 5, it is also easily feasible to use a single hook-shaped guide element 36 which guides the guide elements 17, 18 fitted with an offset rib 27 and which comprises the corresponding guiding surfaces 29 through 34. In this case however the guiding surfaces 30 and 33 cannot be processed by grinding.

Variations of embodiments comprise two kinds of guiding means of which the guiding surfaces 29 through 34 are configured differently. Illustratively a hook-shaped guiding means may be used which comprises the guiding surfaces 29, 30, 31, 34, and a second guide means which is fitted with the guiding surfaces 32, 33. Again, a guide means comprising the guiding surfaces 29, 30, 32, 33 and a further guide means fitted with the guiding surfaces 31, 34 may be used.

Again more than two different guiding means may be used. Illustratively a guide means corresponding to guiding means 19 may be used, which comprises the guiding surfaces 29 and 30, and in addition to said guide means, another one which is fitted with the guiding surfaces 31, 34 and a further guide means fitted with the guiding surfaces 32, 33.

Figure 4:
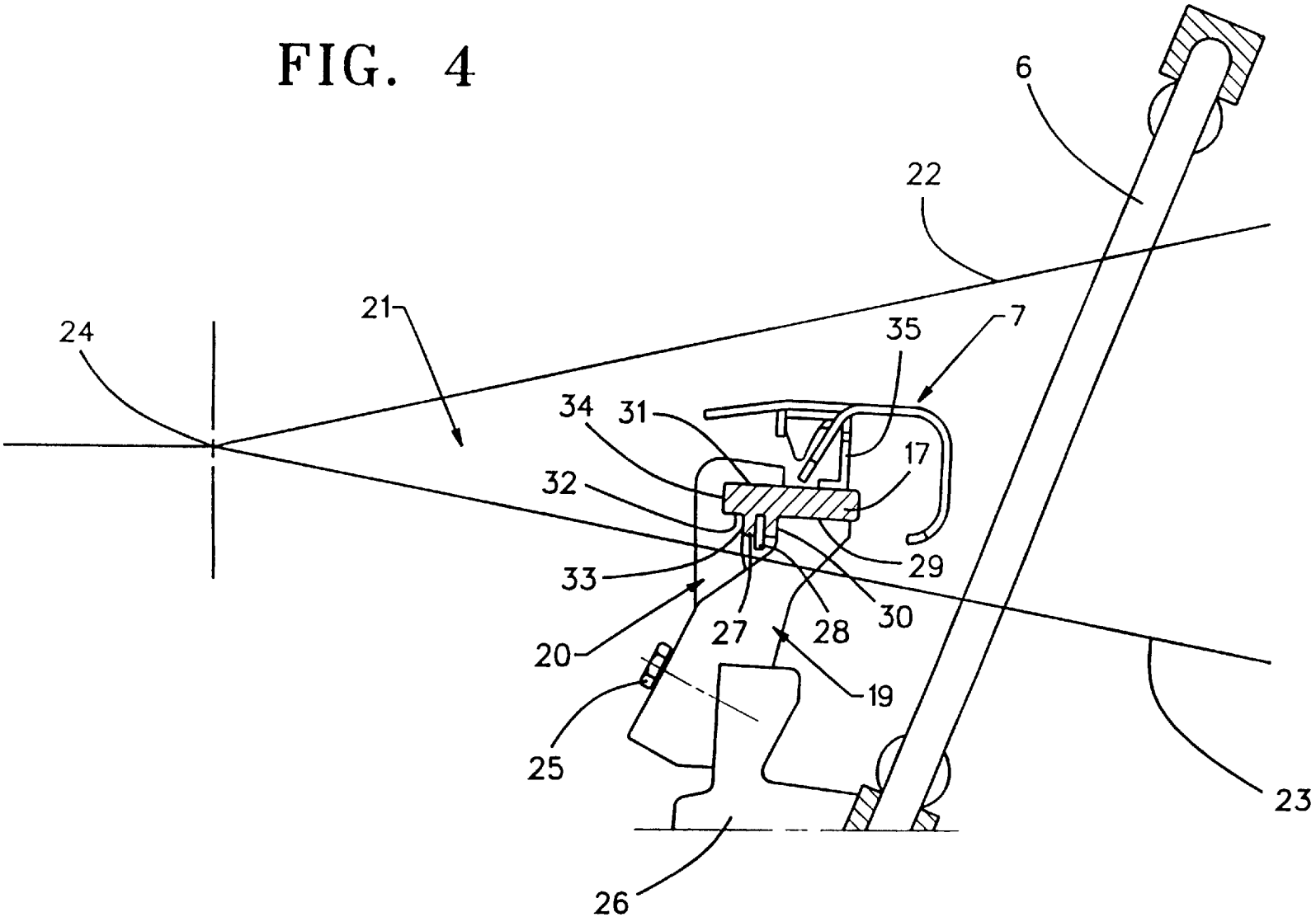
FIG. 4 is a section along line IV—IV of FIG. 1.
Figure 6:
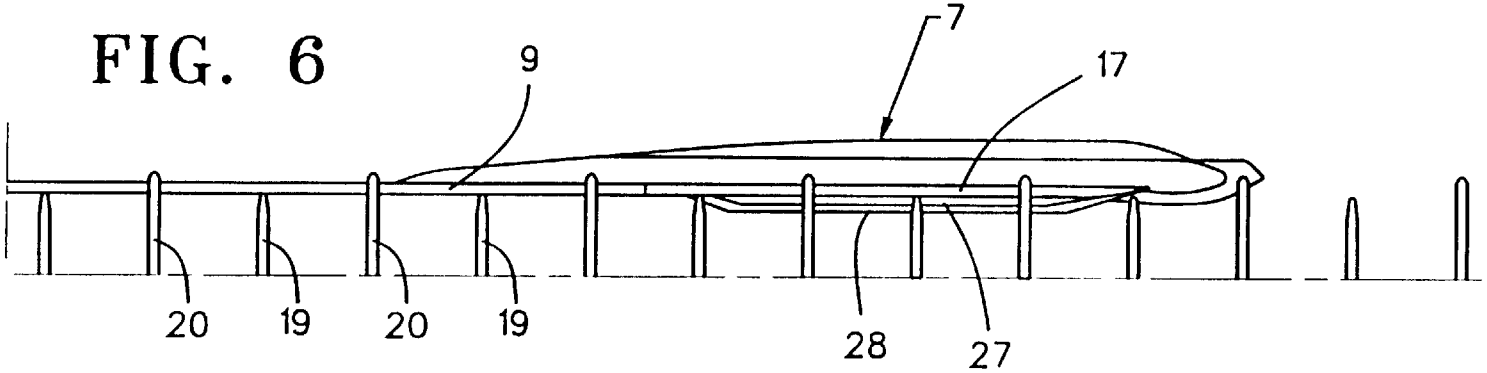
FIG. 6 is an elevation in the direction of arrow F6 of FIG. 2.

FIG. 6 is an elevation of an embodiment corresponding to FIGS. 2 through 4 and wherein the rapier 9 is extended by a guide element 17 supporting the gripper 7. The guide element 17 is fitted with the rib 27 and the deflection rail 28. The guiding means 19, 20 are rounded off or taper upwards to allow them easily passing through the lower set of warps 23 and in the process moving these warps apart.

Figure 7:
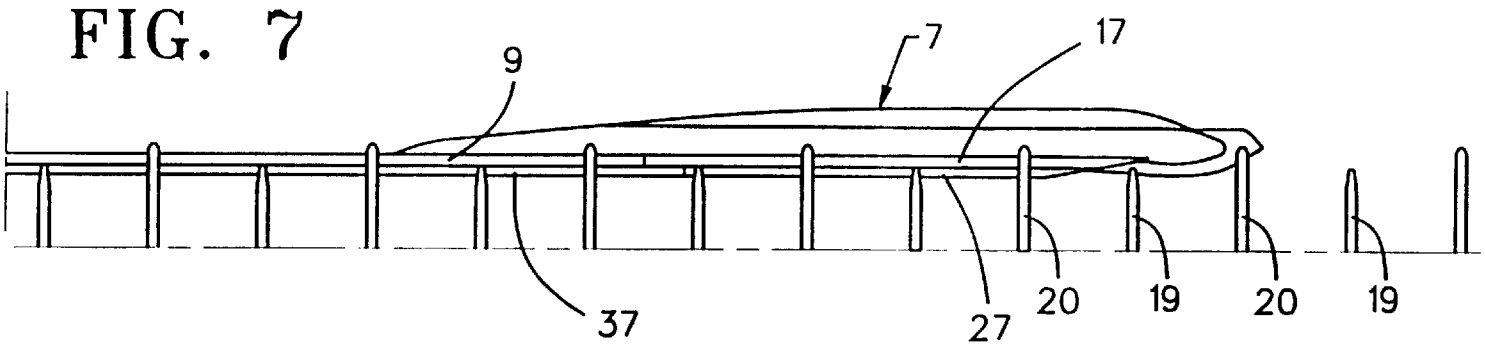
FIG. 7 is a view similar to that of FIG. 6 of an embodiment variation.

In the embodiment of FIG. 7, not only is the guide element 17 of the gripper 7 fitted with a downward-pointing rib 27, but the rapier 9 is fitted with a rib 37 running flush with it. In this design, not only the guide element 17 of the gripper 7, but also the rapier 9 shall be guided over its full length both horizontally and vertically.

Figure 8:
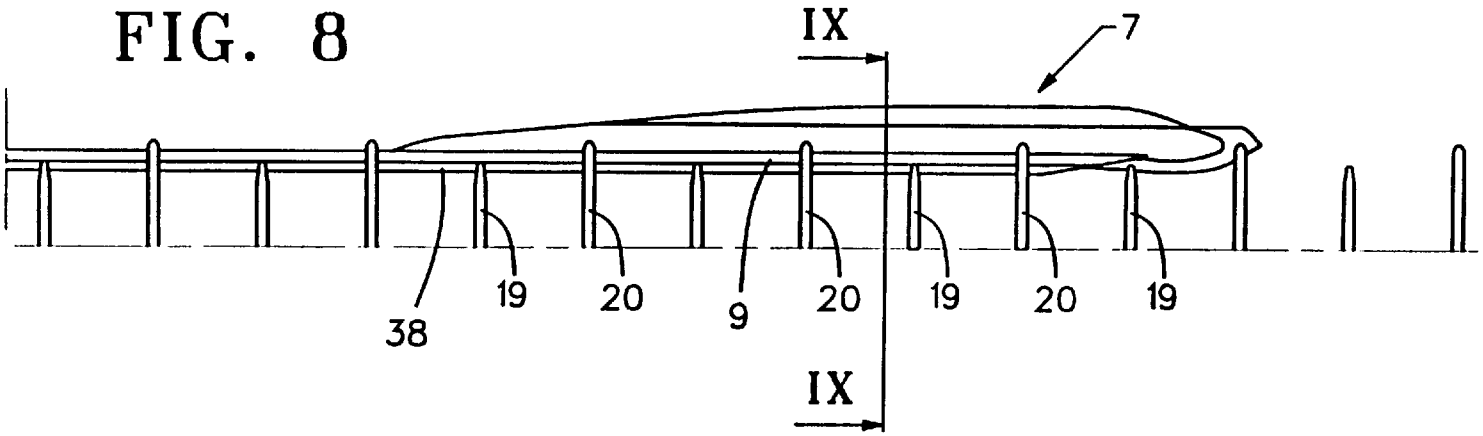
FIG. 8 is a view similar to FIGS. 6 and 7 of still another embodiment of the invention.
Figure 9:
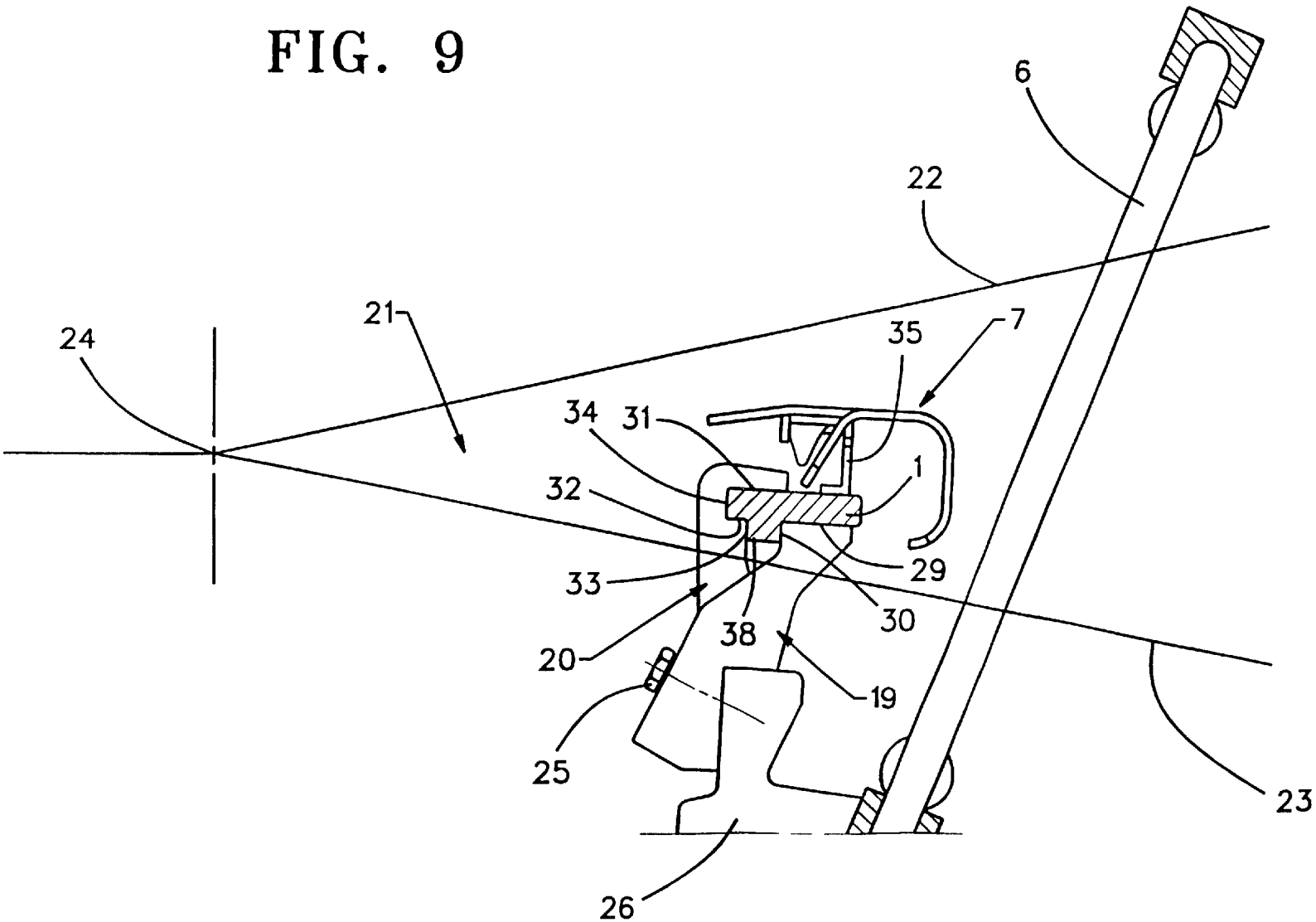
FIG. 9 is a section along line IX—IX of FIG. 8.

As shown in FIGS. 8 and 9, the scope of the invention manifestly also includes eliminating entirely a guide element 17 or 18 for the gripper 7 or 8 while affixing the gripper 7 or 8 directly to the front end of the rapier 9. In this design variation, the rapier 9 is fitted with a longitudinally continuous rib 38.

What is claimed is:

1. A rapier loom comprising at least one rapier for driving a gripper which is held by fastening means and of which the center of gravity is situated above the top side of the rapier, further comprising a batten which supports a reed and on which are mounted guiding means comprising guiding surfaces for the rapier, which are associated with the side of the topside of the rapier away from the reed, with the bottom side of the rapier and with the side surfaces of a downward-projecting rib, and wherein the guiding surface of the guiding means associated with the top side of the rapier extends over more than one third the width of the rapier and in that the fastening means of the gripper are mounted offset to the longitudinal center plane of the rapier in the direction towards the reed.

2. Rapier loom as claimed in claim 1, wherein the rib is mounted a distance from the side surface of the rapier away from the reed.

3. Rapier loom as claimed in claim 2, wherein the guiding means comprise guiding surfaces on both sides of the rib for the bottom side of the rapier.

4. Rapier loom as claimed in claim 1, wherein the gripper is mounted by the fastening means (35) on a guide element configured as an extension of the rapier.

5. Rapier loom as claimed in claim 4, wherein the guide element is fitted with the rib.

6. Rapier loom as claimed in claim 1, wherein at least two different kinds of guiding means are used, each being fitted with one or more guiding surfaces, where the guiding surfaces of one guiding means are opposite the guiding surfaces of the other guiding means.

7. Rapier loom as claimed in claim 1, wherein hook-shaped guiding means are used which comprise on the side away from the reed of the guide element and/or the rapier and/or a guiding surface associated with a side surface of the rapier and a guiding surface associated with the top side of the guide element and/or the top side of the rapier.

8. Rapier loom as claimed in claim 7, wherein the hook-shaped guiding means are fitted with a guiding surface associated with the bottom side of the guide element and/or the bottom side of the rapier in the edge zone next to the rib away from the reed.

9. Rapier loom as claimed in claim 7, wherein the hook-shaped guiding means are fitted with a guiding surface associated with that side of the rib which is away from the reed.

10. Rapier loom as claimed in claim 1, wherein guiding means are used which comprise a guiding surface associated with the bottom side of the guide elements and/or the bottom side of the rapier.

11. Rapier loom as claimed in claim 10, wherein the guiding means comprise a guiding surface associated with a side surface of the rib.

* * * * *